United States Patent [19]

Ishido et al.

[11] Patent Number: 4,838,321

[45] Date of Patent: Jun. 13, 1989

[54] MULTIPLE-PHASE WEAVING FLUID JET LOOM

[75] Inventors: Takao Ishido; Shougo Sasaki; Takao Takahashi, all of Tokyo, Japan

[73] Assignee: Nissan Motor Co., Ltd., Yokohama, Japan

[21] Appl. No.: 92,519

[22] Filed: Sep. 3, 1987

[30] Foreign Application Priority Data

Sep. 4, 1986 [JP] Japan ..... 61-134798[U]
Nov. 25, 1986 [JP] Japan ..... 61-179664[U]

[51] Int. Cl.[4] ..... D03D 47/30
[52] U.S. Cl. ..... 139/20; 139/194; 139/370.2; 139/435
[58] Field of Search ..... 139/435, 194, 370.2, 139/20

[56] References Cited

U.S. PATENT DOCUMENTS 3,299,912 1/1967 Birmins et al. ..... 139/194
3,532,138 10/1970 Schlappi ..... 139/370.2
3,901,286 8/1975 Vermeulen et al. ..... 139/194

FOREIGN PATENT DOCUMENTS 2724923 11/1978 Fed. Rep. of Germany ..... 139/435
42075 10/1972 Japan ..... 139/435
50-9904 4/1975 Japan .
54-18956 2/1979 Japan .
60-155750 8/1985 Japan .

*Primary Examiner*—Henry S. Jaudon
*Attorney, Agent, or Firm*—Foley & Lardner, Schwartz, Jeffery, Schwaab, Mack, Blumenthal & Evans

[57] ABSTRACT

A two-phase weaving air jet loom for parallely weaving two fabrics. The loom is so constructed as to form first and second warp yarn arrays which are separate from each other to define therebetween an intermediate space. First and second weft inserting or air ejection nozzles are disposed near and outside the outside edges of the first and second warp yarn arrays, respectively. The first and second weft inserting nozzles are arranged to project first and second weft yarns into the sheds of the first and second warp yarn arrays, respectively. Additionally, a yarn end portion treating device is provided to treat the end portion (projected over the inside edge of the warp yarn array) of the weft yarn so as to form a selvage and separate the same from a woven cloth.

19 Claims, 8 Drawing Sheets

MULTIPLE-PHASE WEAVING FLUID JET LOOM

OF THE INVENTION

1. Field of the Invention

The present invention relates to a so-called multiple-phase weaving fluid jet loom arranged to weave parallely a plurality of fabrics, and more particularly to an improvement in a so-called two-phase weaving fluid jet loom arranged to weave parallely two fabrics.

2. Description of the Prior Art

In order to accomplish so-called two-phase weaving by using a fluid jet loom, usually a broad loom is used and warp yarns passed on the loom is separated into two groups or two arrays. Additionally, a single weft inserting nozzle is disposed at one side of the loom, and a selvage forming device is disposed between the two warp arrays, in which two fabrics are parallely woven with a weft yarn from the weft inserting nozzle and the two warp arrays.

Otherwise, the two-phase weaving is accomplished by an arrangement disclosed in Japanese Patent Publication No. 50-9904 in which two weft inserting nozzles are disposed between two warp arrays so that two weft yarns are respectively projected from the weft inserting nozzles to the two warp arrays located on the opposite sides of the weft inserting nozzles. Further the Japanese Patent Publication also discloses such an arrangement that the above-mentioned two weft inserting nozzles are combined into a one-piece construction in which the one-piece nozzles are changed 180 degrees in weft projection angle in accordance with weaving cycle of the loom thereby enabling two colour weaving with two kinds of weft yarns.

However, difficulties have been encountered in the above two-phase weaving looms in which kind of weft yarn to be used in the two-phase weaving is limited so that a weft yarn lower in strength cannot be used. This is because in the former case of using the single weft inserting nozzle, when high speed and long weft picking is made by the weft inserting nozzle, a greater tension is applied to the flying weft yarn, or unwinding resistance from a weft package increases, thereby causing weft cutting. In this case, it will be proposed to reduce the unwinding resistance by using a duplex nozzle and two stage weft measuring and storage arrangement; however, delicate timing control is required between two nozzles in the arrangement thereby lowering operational efficiency particularly in preparation stage for multiple colour weaving.

In the latter case of using two nozzles between the two warp arrays, although the above problem is removed by the fact that weft picking length of each nozzle is shortened, the weft path from the weft package to the nozzle is complicated to have many bent portions thereby developing resistance serving as new cause of weft cutting. Particularly, in case of an air jet loom, a weft inserting or air ejection nozzle is considerably long and therefore the closely located two weft inserting nozzles require a larger space, thereby minimizing the weaving width. Furthermore, a demand of disposing many weft measuring and storage devices near the nozzles for multiple colour weaving is difficult to be satisfied because layout of such devices is spacedly limited.

SUMMARY OF THE INVENTION

A multi-phase weaving fluid jet loom according to the present invention is comprised of a device for forming first and second warp yarn arrays which are separate from each other to define therebetween an intermediate space. Each warp yarn array has an inside edge defining the intermediate space and an outside edge opposite to the inside edge. First and second weft inserting nozzles are respectively disposed near and outside the outside edges of the first and second warp yarn arrays. The first and second weft inserting nozzles are arranged to project first and second weft yarn into the sheds of the first and second warp yarn arrays, respectively. Additionally, a yarn end treating device is provided to treat an end portion of each of the first and second weft yarn inserted into the sheds of the first and second warp yarn arrays, in which the weft yarn end portion is projected into the intermediate space over the inside edge of each of the first and second warp yarn arrays.

With this arrangement, the first and second weft yarns are projected from the first and second weft inserting nozzles on the opposite outsides of the first and second warp yarn arrays into the intermediate space between the first and second warp yarn arrays to accomplish weft insertion to the first and second warp yarn arrays. The end portions of the thus inserted first and second weft yarns undergo necessary treatments such as catching, selvage formation and cutting by the yarn end treating device located between the first and second warp yarn arrays, thus parallely weaving two fabrics. Accordingly, the cause of weft yarn cutting in the conventional case of using a single weft inserting nozzle can be removed, while the weft yarn path to the weft inserting nozzles disposed outside the weft yarn arrays becomes simple to have less bent portions thereby removing the cause of weft yarn cutting in the conventional case of using two weft inserting nozzles. Furthermore, the conventional restriction in connection with space for disposing a plurality of weft inserting systems can be removed because such weft inserting systems can be readily disposed outside the warp yarn arrays. Additionally, the yarn end treating device is disposed in the narrow intermediate space between the warp yarn arrays thereby facilitating to obtain a desirable weaving width.

Thus, according to the present invention, in order to accomplish parallel weaving of at least two fabrics, weft yarn path for each fabric is shortened while omitting excessive bending of the weft yarn path, thereby removing causes of weft yarn cutting and removing restriction to selection of kinds of weft yarns. Disposition of the weft inserting systems outside the warp yarn arrays increases the freedom in selection of layout, and disposition of the weft and portion treating device requiring a less occupied space between the warp yarn arrays reduces the restriction for weave width of each woven fabric.

BRIEF DESCRIPTION OF THE DRAWINGS

In the drawings, like reference numerals designate like elements and parts.

DETAILED DESCRIPTION OF THE INVENTION

Figure 1:
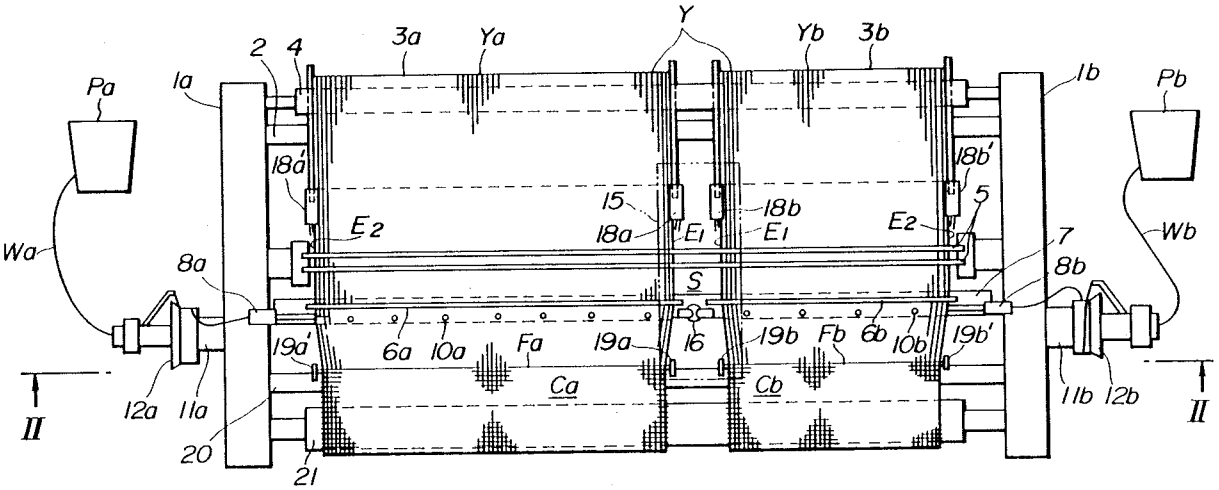
FIG. 1 is a plan view of an embodiment of a multi-phase fluid jet loom in accordance with the present invention.
Figure 2:
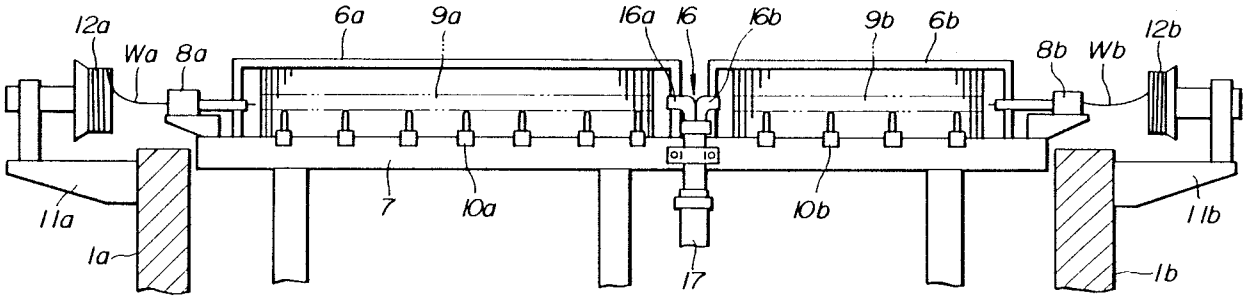
FIG. 2 is a cross-sectional veiw taken in the direction of arrows substantially along the line II—II of FIG. 1.

Referring now to FIGS. 1 and 2, there is shown an embodiment of a two-phase weaving fluid jet loom in accordance with the present invention. The loom of this embodiment is of the air jet type and for wide fabric. The loom is comprised of side frames 1*a*, 1*b* between which a beam shaft 2 is bridged laterally. First and second yarn beams 3*a*, 3*b* are mounted on the beam shaft 2 and spaced from each other. Warp yarns Y are divided into two groups or two warp yarn arrays Ya, Yb which are passed respectively on the first and second yarn beams 3*a*, 3b. The yarn beams 3*a*, 3*b* are arranged to be rotated at a low speed by means of respective warp yarn feeding devices (not shown) thereby to feed the warp yarns Y. The inside edges $E_1$ of the yarn arrays Ya, Yb are spaced from each other to define therebetween a space S. The outside edges $E_2$ of the warp yarn arrays Ya, Yb are positioned opposite and located near the side frames 1*a*, 1b, respectively. The first and second warp yarn arrays Ya, Yb are turned by a common tension roll 4 and thereafter undergone shedding motion by common healds 5. Then, the first and second warp yarn arrays Ya, Yb are passed through respective reeds 6*a*, 6*b* to reach respective cloth fells Fa, Fb.

The reads 6*a*, 6*b* are installed to a reed holder 7 in such a manner as to be adjustable in location. First and second weft inserting or fluid (air) ejection nozzles 8*a*, 8*b* are disposed outside the wrap yarn arrays Ya, Yb and arranged to project a weft yarn under influence of fluid jet ejected therefrom. More specifically, the first weft inserting nozzle 8a is located outside the outside edge $E_2$ of the first warp yarn array Ya, while the second weft inserting nozzle 8*b* is located outside the outside edge $E_2$ of the second warp yarn array Yb. The first and second weft inserting nozzles 8*a*, 8*b* are fixed on the reed holder 7. As best shown in FIG. 2, each reed 6*a*, 6*b* includes a plurality of reed blades each being formed at its front face with a groove. A laterally extending row of the grooves forms an air guide channel 9*a*, 9*b* through which air stream is produced to guide therethrough the weft yarn projected from the weft inserting nozzle 8*a*, 8*b*. Additionally, a plurality of auxiliary nozzles 10*a*, 10*b* are fixedly disposed immediately in front of the air guide channel 9*a*, 9*b* and arranged to eject auxiliary air obliquely toward the air guide channel 9*a*, 9*b* to enhance the air stream in the air guide channel 9*a*, 9*b*. Thus, an air guide system for weft yarn known per se is constituted by the weft inserting nozzle 8*a*, 8*b*, air guide channel 9*a*, 9*b*, the auxiliary nozzles 10*a*, 10*b* and the like.

First and second weft measuring and storage devices 12*a*, 12*b*, for example, of the so-called drum type are fixedly mounted through brackets 11*a*, 11*b* to the outside walls of the side frames 1*a*, 1*b*, respectively, in such a manner as to be adjustable in position. The weft yarn Wa, Wb from the weft packages Pa, Pb are introduced through this weft measuring and storage device 12*a*, 12*b* to the weft inserting nozzle 8*a*, 8*b*. It will be understood that in case of multiple colour weaving, the number of a unit including the weft package Pa, the weft measuring and storage device 12a and the weft inserting nozzle 8*a* and another unit including the weft package Pb, the weft measuring and storage device 12*a* and the weft inserting nozzle 8*b* is selected in accordance with the number of the corresponding weft yarns.

A weft end portion treating device 15 is disposed between the first and second warp yarn arrays Ya, Yb and, in this embodiment, includes weft yarn end portion catching device 16 as shown in FIG. 2. The weft yarn end portion catching device 16 includes first and second suction pipes 16*a*, 16*b* which are fixed on the reed holder 7 and located opposite through the air guide channels 9*a*, 9*b* to the weft inserting nozzles 8*a*, 8*b*, respectively. More specifically, the axes of the weft inserting nozzle 8*a*, 8*b* and the suction pipe 16*a*, 16*b* are aligned with each other in such a manner that the extensions of them pass through the air guide channel 9*a*, 9*b*. These suction pipes 16*a*, 16*b* are fluidly connected through a suction hose 17 to a vacuum source (not shown). A waste yarn filter such as wire gauze is disposed in the line between the suction pipe 16*a*, 16*b* and the vacuum source.

First and second selvage forming devices 18*a*, 18*b* forming part of the weft end portion treating device 15 are positioned between and over the first and second warp yarn arrays Ya, Yb. Each selvage forming device 18*a*, 18*b* is arranged to feed two catch cords which are being twisted, so that the end portion of the inserted weft yarn Wa, Wb is engaged between the two catch cords thereby to form a selvage of a woven fabric Ca, Cb at the inside edge $E_1$. Additionally, first and second weft cutters 19*a*, 19*b* are installed to a cloth fell base 20 and arranged to make their shearing action to cut the end portions of the respective inserted weft yarns Wa, Wb. Similar selvage forming devices 18*a*', 18*b*' and weft cutters 19*a*', 19*b*' are disposed outside the outside edges $E_2$ of the first and second warp yarn arrays Ya, Yb, respectively, thereby forming selvage of each woven fabric Ca, Cb at the outside edge $E_2$. While the weft end portion treating device 15 has been shown and described as including the weft yarn end catching device 16, the selvage forming devices 18*a*, 18*b* and the weft cutters 19*a*, 19*b*, it will be understood that the device 15 consists of only the weft yarn end catching device 16.

The manner of operation of the thus arranged loom will be discussed hereinafter.

When a weft inserting or picking timing comes near in a backward moving step of the reeds 6*a*, 6*b*, air under pressure is ejected from the weft inserting nozzles 8*a*, 8*b*. Then, at a weft inserting timing, the weft measuring and storage devices 12*a*, 12*b* release respectively the weft yarns Wa, Wb having predetermined lengths, and therefore the weft yarns Wa, Wb are projected respectively from the weft inserting nozzles 8a, 8b under influence of pressurized air. The weft yarns Wa, Wb are further blown up respectively by air streams produced by the auxiliary nozzles 10a, 10b so as to fly and move through the air guide channel 9a, 9b thereby to be inserted or picked into the sheds of the first and second warp yarn arrays Ya, Yb, respectively. At a termination period of this weft insertion, the respective end portions of the weft yarns Wa, Wb are respectively sucked into the first and second suction pipes 16a, 16b to be caught and kept in tension. During this, the reeds 6a, 6b have become at its forward moving step, in which the above-mentioned tensioned weft yarns Wa, Wb are respectively beaten up against cloth fells Fa, Fb of the woven fabrics Ca, Cb. Nearly simultaneously with this, the catch cords from the selvage forming devices 18a, 18a' and the selvage forming devices 18b, 18b' catch respectively the end portions of the inserted weft yarns Wa, Wb in such a manner that the weft yarn end portion is entangled with the catch cords, thereby forming the selvages of the woven fabrics Ca, Cb. Immediately after this, the weft cutters 14a, 14b operate to cut the weft yarns Wa, Wb leading to the weft inserting nozzles 8a, 8b. Thereafter, the weft cutters 19a, 19b operate to cut the end portions of the inserted weft yarns Wa, Wb caught upon being sucked into the suction pipes 19a, 19b, so that the end portions of the weft yarns Wa, Wb become separated from the main portions of the weft yarns. Thus, weaving of the woven fabrics Ca, Cb are completed. The woven fabrics Ca, Cb are turned in direction by a breast beam 21. The cut and separated end portions of both the weft yarns Wa, Wb are sucked through the suction hose 17 and caught by the waste yarn filter.

In case of multiple colour weaving, the above-mentioned respective units each including the weft measuring and storage device and the weft inserting nozzle may be selectively operated, in which no change is made in operation of the weft end portion treating device 15 and therefore no change is made in space for disposing the device 15. It will be understood that the selvage forming device 18a, 18b and the weft cutters 19a, 19b in the weft end portion treating device 15 may be replaced with known ones, respectively. The weft yarn end catching device 16 may also be replaceable with one of the type other than that mentioned above.

In this embodiment, since the weft end portion treating device 15 is of the type using suction pipes, the oppositely advancing air streams through the air guide channels 9a, 9b can be sucked together with the picked weft yarn end portions into the suction pipes 16a, 16b, so that behaviour of the picked weft yarn end portions are prevented from disturbance due to striking of the oppositely advancing air streams. This effect is attained similarly to in a water yet loom in which oppositely advancing water jet streams are used in place of the air streams. The two yarn beams 3a, 3b may be replaced with a single yarn beam; however, such a two yarn beam structure in the embodiment facilitates warping and looming operation while facilitating weaving of two fabrics of different kinds.

While only the two-phase (two fabrics) weaving loom has been shown and described, it will be understood that a varity of weaving modes may be applicable to the loom of the present invention, in which, for example, a further weaving mechanism for a further one fabric weaving is added or the mechanism for a further two-phase (two fabrics weaving) is added.

Although the catch cords from the selvage forming devices 18a, 18b have been described as being used in combination with the weft yarn end portion catching device 16 in order to catch the end portion of the inserted weft yarn in the above-mentioned embodiment, it will be appreciated that only catch cords or the like may be used without using the weft yarn end portion catching device 16 of the type described above.

Figure 3:
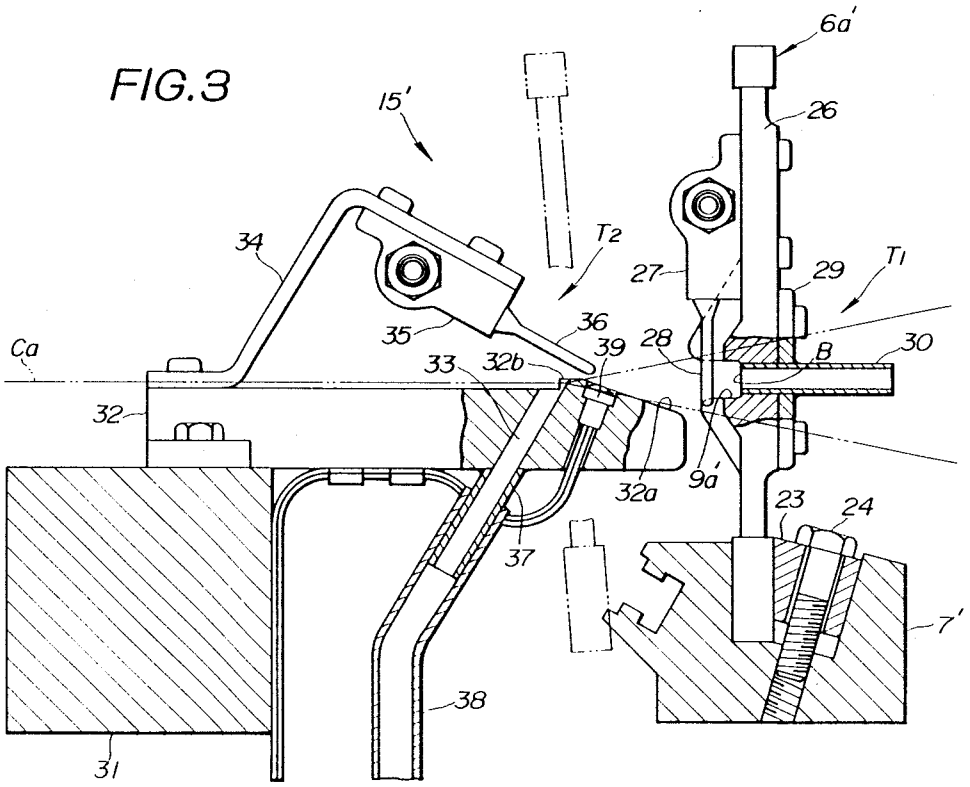
FIG. 3 is a side view, partly in section, of an arrangement showing an essential part or a weft end portion treating device replaceable with that of the loom of FIG. 1.
Figure 4:
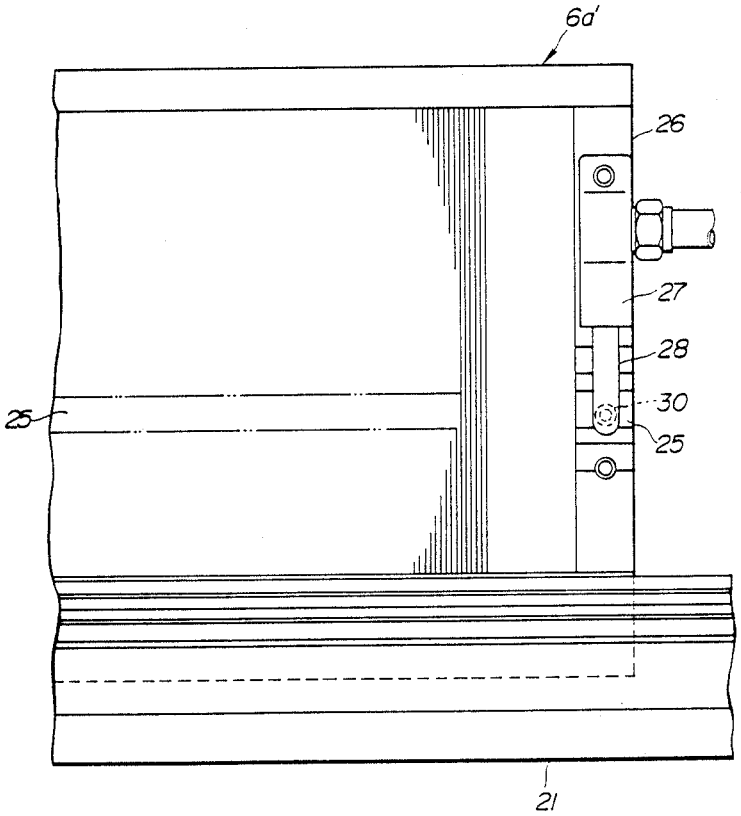
FIG. 4 is a fragmentary front elevation of the arrangement of FIG. 3.
Figure 5:
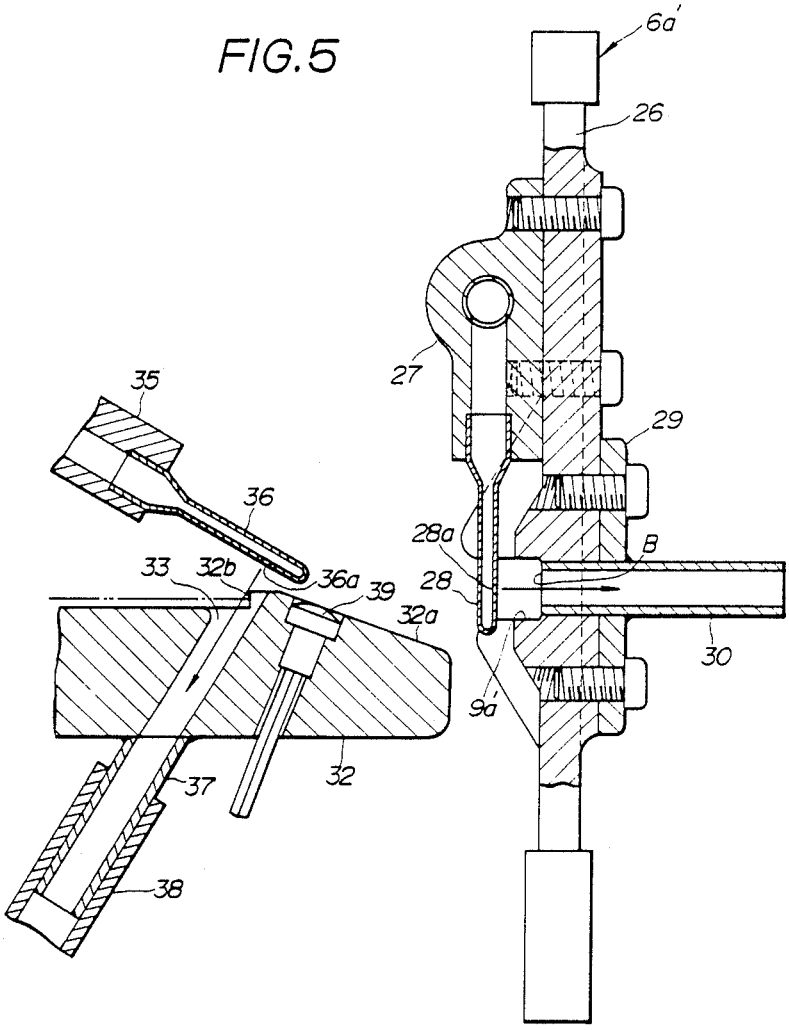
FIG. 5 is an enlarged side view of an essential part of the arrangement of FIG. 3.

FIGS. 3 to 5 illustrates an essential part of another example of the weft end portion treating device 15' to be used in place of that 15 in FIG. 1. In this case, the weft end portion treating device 15' is incorporated with the loom having the reed holder 7' which makes its forward and backward swinging movement in the loom. A reed 6a' is fixedly secured to the reed holder 7' by means of a wedge member 23 and a bolt 24. The reed 6a' is formed with the air guide channel 9a' which extends also through a side frame 26 of the reed 6a' located on a counter weft picking side (opposite to a weft picking side where a weft inserting nozzle is located). A nozzle holder 27 is fixed to a face of the side frame 26 which face is on the side of the cloth fell of the woven fabric Ca. The nozzle holder 27 securely holds a nozzle 28 in such a manner that the axis of an air ejection hole 28a of the nozzle 28 is directed to the bottom face B of the air guide channel 9a'. The side frame 26 is fixedly provided at its face on the opposite side of the cloth fell with a bracket 29 for securely supporting a pipe 30. One end of the pipe 30 pierces the side frame 26 and opens to the bottom face B of the air guide channel 9a' in such a manner as to be opposed to the air ejection hole 28a of the nozzle 28. Accordingly, the nozzle 28 and the pipe 30 keep the end portion of the weft yarn in a tensioned state before bearing-up stage under the action of air stream and therefore constitutes a first yarn end tensioning device $T_1$ forming part of the weft end portion treating device 15'.

A weft guide 32 is fixedly secured to a stay 31 of the loom and located between the inside edge $E_1$ of the woven fabric Ca and the side frame 26 of the reed 6a' to introduce the weft yarn to the cloth fell during beating-up stage. The weft guide 32 is formed at its upper part with an inclined guide portion 32a and further formed with a ratch-shaped engaging portion 32b located at the terminal end of the inclined guide portion 32a or at a position corresponding to the cloth fell. Additionally, the weft guide 32 is formed with a hollow hole 33 whose one end opens to the rachet-shaped engaging portion 32b. A nozzle holder 35 is securely installed through a bracket 34 to the weft guide 32 and securely holds a nozzle 36 which has an air ejection opening 36a whose axis is directed to the hollow hole 33. Thus, the nozzle 36 and the hollow hole 33 function to take over the weft yarn end portion from the first yarn end tensioning device $T_1$ and to keep it in the tensioned state and therefore constitute a second yarn end tensioning device $T_2$ forming part of the weft end portion treating device 15'. As shown, a pipe 37 aligned with the hollow hole 33 is welded to the bottom face of the weft guide 32 so that the opening of the pipe 37 communicates with the weft guide hollow hole 33. An elongate tube 38 is connected to this pipe 37.

A photoelectric weft detector 39 is provided to be exposed flush with the inclined guide portion 32a of the weft guide 32 and adapted to detect the weft yarn during its movement to reach the cloth fell along the inclined guide portion 32a. It will be understood that the weft detector 39 may not be limited to that of the photoelectric type and therefore those other than of the photoelectric type may be used for the weft detector.

Figure 6:
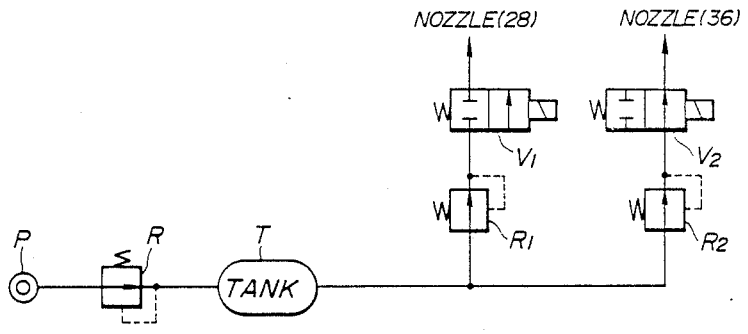
FIG. 6 is a diagramatic illustration showing a fluid circuit for supplying fluid to nozzles of the arrangement of FIG. 3.
Figure 7:
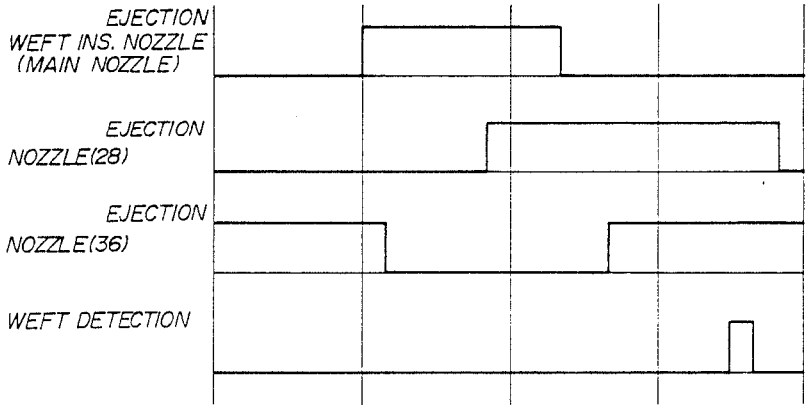
FIG. 7 is a diagram showing fluid ejection timings of the nozzles of FIG. 6 and the likes.

As shown in FIGS. 6, the nozzles 28, 36 are arranged to be supplied with pressurized air from a pressurized air supply source P via a line including a regulator R and a tank T. The line leading to the nozzle 28 further includes a regulator $R_1$ and an electromagnetic valve $V_1$ while the line leading to the nozzle 36 further includes a regulator $R_2$ and an electromagnetic valve $V_2$. With this pressurized air supply arrangement, pressurized air is ejected from the nozzles 28, 36 in the timings shown in FIG. 7.

The operation of the above essential part of the weft end portion treating device 15' will be discussed with reference to FIGS. 8A to 8C.

Figure 8A:
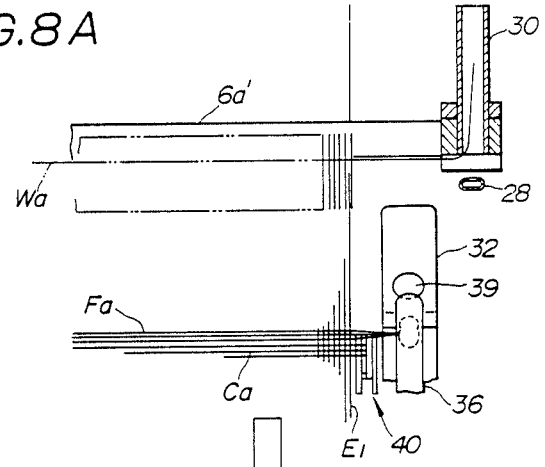
FIGS. 8A to 8C are schematic plan views showing operation of the arrangement of FIG. 3.
Figure 8B:
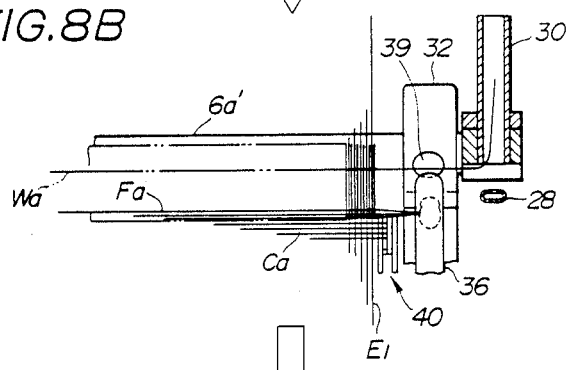

When the weft yarn Wa is picked or inserted from the weft inserting nozzle (main nozzle), the end portion of the picked weft yarn Wa is introduced into the pipe 30 by air ejection from the nozzle 28 and kept in a tensioned state under the influence of air stream from the nozzle 28 to the inside of the pipe 30 as shown in FIG. 8A. In this state, beating-up with the reed is made in which the weft yarn Wa' passes over the weft detector 39 along the inclined guide portion 12*a* of the weft guide 32 as shown in FIG. 8B. Accordingly, judging as to whether the weft yarn exists or not (i.e., weft insertion is accomplished or not) is made in accordance with signal from the weft detector 39. If no weft yarn exists, the loom is stopped.

Figure 8C:
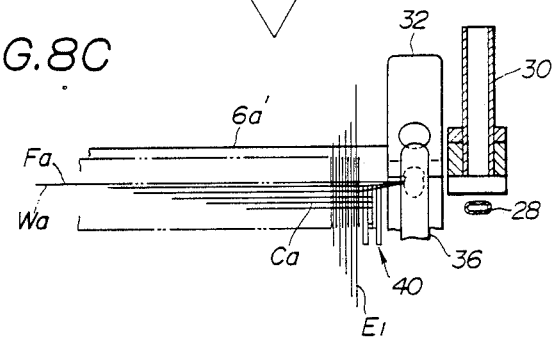

Thereafter, when the weft yarn Wa comes to the cloth fell Fa, the weft yarn Wa is caught by the ratch-shaped engaging portion 32*b* as shown in FIG. 8C and therefore prevented from its backward movement. Simultaneously, by air ejection from the nozzle 36, the weft yarn Wa gets out of the pipe 10 and is guided into the hollow hole 33 of the weft guide 32 to be continuously kept in the tensioned state under the action of air stream from the nozzle 36 to the hollow hole 33. Such tensioned state of the weft yarn Wa is maintained for several picks, during which a selvage of the woven fabric Ca is formed.

After the several picks, the weft yarn Wa is cut by a cutter 40 located between the inside edge $E_1$ of the woven fabric Ca and the weft guide 32. Waste yarn produced at this time is gathered through the tube 18 into a waste yarn box (not shown).

As discussed above, the picked weft yarn can be kept in a suitable tensioned state by two yarn end tensioning devices $T_1$, $T_2$ from a timing of weft insertion completion through beating-up stage to a timing after several picks, and therefore rigid selvage structure can be formed without using catch cords for catching the end portion of the picked weft yarn.

While only an arrangement including the first and second yarn end tensioning devices $T_1$, $T_2$ for the fabric Ca in FIG. 3 has been shown and described as an essential part of the weft end portion treating device 15', it will be appreciated that the same arrangement is used for the fabric Cb in FIG. 3. In other words, the weft end portion treating device 15' is comprised of a pair of such arrangements each having the first and second yarn end tensioning devices $T_1$, $T_2$, for the fabrics Ca, Cb.

Figure 9:
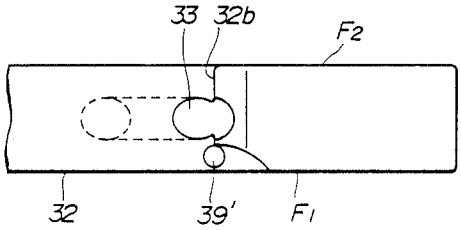
FIG. 9 is a fragmentary plan view of a modified example of a weft guide used in the arrangement of FIG. 3.
Figure 10:
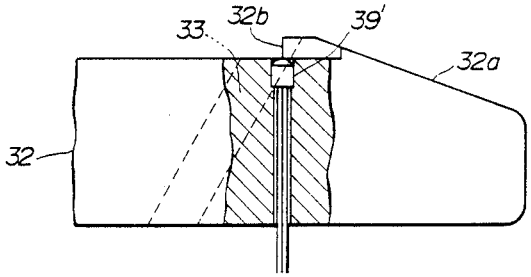
FIG. 10 is a side view, partly in section, of the weft guide of FIG. 9.

FIGS. 9 and 10 show another example of the weft guide 32 which is similar to that of the embodiment of FIGS. 3 to 5 except for the location of the photoelectric weft detector 39'. This is arranged to detect mispick in addition to detection of existence of the weft yarn under the above-mentioned movement manner of the weft yarn discussed in connection with the example of FIGS. 3 to 5. In this example, the top surface of the weft detector 39' is flush with the top surface of the weft guide 32 and located between the hollow hole 33 and the side face $F_1$ of the weft guide 32 which side face is on the counter weft picking side as compared with the opposite side face $F_2$.

With this arrangement, when mispick (due to weft yarn cutting at a central part of the yarn or on the weft picking side) which cannot be detected by a usual weft detector occurs, the picked weft yarn is in such a condition that there is a considerably long yarn projected from the inside edge $E_1$ of the woven fabric. As a result, the end portion of the picked weft yarn cannot completely come out of the first yarn end tensioning device $T_1$ including the nozzle 28 and the pipe 30 installed to the reed 6*a*, and therefore the weft yarn is existing on the weft detector 39'. Thus, the weft detector 39' detects the existence of the weft yarn, so that judging of weft yarn cutting is made. Since this judging is made in a tensioned and nearly stationary state of the weft yarn, reliability of the detection is increased while rendering unnecessary a special space for disposing a separate weft detector therefor.

What is claimed is:

1. A fluid jet loom comprising:

means for forming a first warp yarn array which has first and second opposite edges;

a first weft inserting nozzle disposed near the first edge of said first warp yarn array and arranged to project a first weft yarn into a shed of said first warp yarn array; and a weft yarn end portion treating device for treating an end portion of the first weft yarn inserted into the shed of the first warp yarn array, said end portion being projected over the first edge of said first warp yarn array, said weft yarn end portion treating device including a first weft yarn end portion tensioning mechanism for said first warp yarn array being disposed near the second edge of said first warp yarn array and including (a) a first weft yarn end portion tensioning means for keeping the weft yarn end portion in a tensioned state before beating-up via a reed, said first weft yarn end portion tensioning means being incorporated with said reed, wherein said first weft yarn end portion tensioning means includes a first fluid ejection nozzle fixedly secured to said reed to eject fluid, and a pipe fixedly secured to said reed to receive the fluid ejected from said first fluid ejection nozzle and to be supplied with said weft yarn end portion, and (b) a second weft yarn end portion tensioning means which maintains the tensioned state of said weft yarn end portion as established by said first weft yarn end portion tensioning means, said second weft yarn end portion tensioning means being located between said first warp yarn array second edge and said first weft yarn end portion tensioning means, wherein said second weft yarn end portion tensioning means includes a second fluid ejection nozzle fixedly connected to the frame of the loom to eject fluid, and a hole into which the fluid ejected from said second fluid ejection nozzle is fed so that said weft yarn end portion is supplied into said hole, and means for positioning said weft yarn end portion to be supplied to said hole.

2. A fluid jet loom as claimed in claim 1, further comprising means for forming a second warp yarn array to define therebetween an intermediate space, said second warp yarn array having first and second opposite edges, the intermediate space being defined between the second edges of said first and second warp yarn array, and a second weft inserting nozzle disposed near the first edge of said second warp yarn array and arranged to project a second weft yarn into a shed of said second warp yarn array, wherein said weft yarn end portion treating device is arranged to treat the end portion of each of the first and second weft yarns inserted into the sheds of said first and second warp yarn arrays, the weft yarn end portions being projected into the intermediate space over the second edge of each of said first and second warp yarn arrays, said weft yarn end portion treating device including a second weft yarn end portion tensioning mechanism for said second warp yarn arrays, disposed near the second edge of said second warp yarn array, said second weft yarn end portion tensioning mechanism being substantially the same in construction as said first weft yarn end portion tensioning mechanism.

3. A fluid jet loom as claimed in claim 2, wherein the first and second edges of each of first and second warp yarn arrays correspond respectively to outside and inside edges.

4. A fluid jet loom as claimed in claim 2, wherein each of said first and second weft inserting nozzles is fluidly connected to a pressurized fluid source so as to eject fluid to carry said weft yarn through the shed of said warp yarn array.

5. A fluid jet loom as claimed in claim 2, wherein said first and second warp yarn arrays forming means includes first and second yarn beams on which said first and second warp yarn arrays are passed on.

6. A fluid jet loom as claimed in claim 2, further comprising first and second reeds respectively for first and second warp yarn arrays, each of said first and second reeds including a plurality of reed blades having respectively grooves, said grooves constituting a fluid guide channel through which fluid stream carrying said weft yarn is guided.

7. A fluid jet loom as claimed in claim 1, further comprising means for transferring said weft yarn end portion from said first weft yarn end portion tensioning means to said second weft yarn end portion tensioning means in timed relation to weaving cycle of the loom.

8. A fluid jet loom as claimed in claim 1, wherein said hole and said weft yarn end portion positioning means are included in a weft guide secured to said loom frame, said weft guide being formed with an inclined guide surface on which said weft yarn end portion slides to be moved toward the cloth fell under pushing action of said reed.

9. A fluid jet loom as claimed in claim 8, wherein said weft yarn end portion positioning means includes a ratch-shaped engaging portion formed on said weft guide and located such that said weft yarn end portion caught by said ratch-shaped engaging portion is able to be supplied to said hole under influence of fluid ejected from said second fluid ejection nozzle.

10. A fluid jet loom as claimed in claim 9, further comprising a weft detector for detecting existence of said weft yarn end portion of a position outside said first warp yarn array second edge.

11. A fluid jet loom as claimed in claim 10, wherein said weft detector is photoelectric type and has a top surface positioned in and generally flush with said weft guide inclined guide surface.

12. A fluid jet loom as claimed in claim 11, wherein said weft detector is photoelectric type and has a top surface positioned in top surface of said weft guide between said hollow hole and a side surface opposite to side of said weft inserting nozzle.

13. A fluid jet loom as claimed in claim 2, wherein an axis of said first fluid ejection nozzle is aligned with inside opening of said pipe.

14. A fluid jet loom as claimed in claim 2, wherein an axis of said second fluid ejection nozzle is aligned with said hole.

15. A fluid jet loom as claimed in claim 2, whrein said first and second fluid ejection nozzles are fluidly connected to a pressurized air source and adapted to be controlled to eject fluid at predetermined timings, respectively, in relation to weaving cycle of the loom.

16. A multiple-phase weaving fluid jet loom comprising:

means for forming first and second warp yarn arrays which are separate from each other to define therebetween an intermediate space, each warp yarn array having an inside edge defining the intermediate space and an outside edge opposite to the inside edge;

first and second weft inserting nozzles respectively disposed near and outside the outside edge of said first and second warp yarn arrays, said first and second weft inserting nozzles being arranged to project first and second weft yarns into sheds of said first and second warp yarn arrays, respectively; and a yarn weft end portion treating device for treating an end portion of each of said first and second weft yarns inserted into the sheds of the first and second warp yarn arrays, said end portions being projected into said intermediate space over the inside edge of each of said first and second warp yarn arrays, said treating device including a first and second weft yarn tensioning mechanism respectively for said first and second warp yarn arrays, each of said tensioning mechanisms including (A) a first weft yarn end portion tensioning means for keeping said end portion tense before beating-up via a reed, said first tension means including a first ejection fluid nozzle fixedly secured to said reed to eject fluid and a pipe fixedly secured to said reed to receive said ejected fluid and to be supplied with said end portion; (B) a second weft yarn end portion tensioning means for taking over said weft yarn end portion from said first weft yarn end portion tensioning means and keeping said weft yarn end portion tense, said second weft yarn end portion tensioning means being located between said first warp yarn array inside edge and said first weft yarn end portion tensioning means and includes (1) a second fluid nozzle fixedly connected to the frame of the loom to eject fluid and (2) a weft guide secured to said loom frame, said weft guide having an inclined guide surface on which said weft yarn end portion slides to be moved toward the cloth fell under pushing action of said reed and including (a) a hole into which the fluid ejected from said second fluid ejection nozzle is fed so that said end portion is supplied into said hole and (b) means for positioning said end portion to be supplied to said hole, said positioning means including a ratch-shaped engaging portion formed on said weft guide and located such that said weft yarn end portion caught by said ratch-shaped engaging portion is able to be supplied to said hollow hole under influence and fluid ejected from said second fluid ejection nozzle; and (c) means for transferring said weft yarn end portion from said first weft yarn end portion tensioning means to said second weft yarn end portion tensioning means in timed relation to weaving cycle of the loom.

17. A multiple-phase weaving fluid jet loom as claimed in claim 16, further comprising a weft detector for detecting existence of said weft yarn end portion at a position outside said first warp yarn array inside edge.

18. A multiple-phase weaving fluid jet loom as claimed in claim 17, wherein said weft detector is photoelectric type and has a top surface positioned in and generally flush with said weft guide inclined guide surface.

19. A multiple-phase weaving fluid jet loom as claimed in claim 18, wherein said weft detector is photoelectric type and has a top surface positioned in top surface of said weft guide between said hollow hole and a side surface opposite to said of said weft inserting nozzle.

* * * * *